US011691701B2

(12) United States Patent
Simard

(10) Patent No.: US 11,691,701 B2
(45) Date of Patent: Jul. 4, 2023

(54) WATERCRAFT HAVING A CONDUIT IN AN INTERNAL VOLUME OF A HULL

(71) Applicant: BOMBARDIER RECREATIONAL PRODUCTS INC., Valcourt (CA)

(72) Inventor: Richard Simard, Drummondville (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 7 days.

(21) Appl. No.: 17/555,699

(22) Filed: Dec. 20, 2021

(65) Prior Publication Data

US 2022/0194530 A1 Jun. 23, 2022

Related U.S. Application Data

(60) Provisional application No. 63/127,332, filed on Dec. 18, 2020.

(51) Int. Cl.
*B63B 59/06* (2006.01)
*B63B 1/04* (2006.01)

(52) U.S. Cl.
CPC ..... *B63B 59/06* (2013.01); *B63B 1/042* (2013.01)

(58) Field of Classification Search
CPC ..... B63B 59/00; B63B 59/04; B63B 59/06
USPC ..... 114/222, 343
See application file for complete search history.

(56) References Cited

U.S. PATENT DOCUMENTS 3,864,260 A * 2/1975 Banner ..... B01D 29/666 210/411
7,811,142 B2 * 10/2010 Olenio ..... B63B 59/08 440/88 M
11,420,715 B1 8/2022 Simard et al.
11,459,064 B1 10/2022 Simard et al.

* cited by examiner

*Primary Examiner* — Daniel V Venne
(74) *Attorney, Agent, or Firm* — BCF LLP

(57) ABSTRACT

A watercraft has an unsealed hull that is permeable such that, in use, water flows at least partly into an internal volume of the hull. The hull has at least one hull panel having inner and outer panel surfaces. At least one buoyant element is disposed within the internal volume of the hull. A conduit extends within the internal volume of the hull and defines at least one outlet for discharging water therethrough. An inlet connector of the conduit is configured to be connected to an external water source in order to supply water to the conduit. In response to the external water source being connected to the inlet connector, water flows through the conduit, out of the at least one outlet of the conduit, and onto at least a portion of at least one of the inner panel surface and the at least one buoyant element for rinsing thereof.

20 Claims, 15 Drawing Sheets

WATERCRAFT HAVING A CONDUIT IN AN INTERNAL VOLUME OF A HULL

CROSS-REFERENCE

The present application claims priority from U.S. Provisional Patent Application No. 63/127,332, filed Dec. 18, 2020, the entirety of which is incorporated by reference herein.

FIELD OF TECHNOLOGY

The present technology relates to watercraft, and particularly to the rinsing of a watercraft's hull.

BACKGROUND

Watercraft are regularly exposed to various types of organisms in the bodies of water in which they navigate, including different types of plants, fish, micro-organisms and other aquatic organisms (e.g., mollusks). Some of these organisms, if introduced into foreign bodies of water, can negatively affect the ecosystems thereof, notably in some cases out-competing native species of those ecosystems. Those organisms are commonly referred to as aquatic invasive species (AIS). One of the more common vectors for introducing AIS into a body of water is hull fouling whereby the AIS attach themselves to a watercraft's hull.

In order to address this issue, the outer surface of a watercraft's hull is usually rinsed prior to the watercraft being launched into a body of water so as to wash off any AIS that may have clung onto the hull. However, this may not be sufficient in some cases, particularly where the hull may not be fully sealed.

In view of the foregoing, there is a need for a watercraft that addresses at least some of these drawbacks.

SUMMARY

It is an object of the present technology to ameliorate at least some of the inconveniences present in the prior art.

According to an aspect of the present technology, there is provided a watercraft. The watercraft comprises: a deck; a hull supporting the deck, the hull being an unsealed hull that is permeable such that, in use, water flows at least partly into an internal volume of the hull, the hull comprising: at least one hull panel having an inner panel surface and an outer panel surface, the outer panel surface defining at least in part an outer surface of the hull, the inner panel surface at least partially defining the internal volume of the hull, the internal volume extending beneath the deck; and at least one buoyant element disposed within the internal volume of the hull; and a conduit extending within the internal volume of the hull, the conduit defining at least one outlet for discharging water therethrough, the conduit comprising an inlet connector configured to be connected to an external water source in order to supply water to the conduit. In response to the external water source being connected to the inlet connector, water flows through the conduit, out of the at least one outlet of the conduit, and onto at least a portion of at least one of the inner panel surface and the at least one buoyant element for rinsing thereof.

In some embodiments, the at least one hull panel is a plurality of hull panels connected to one another to form the outer surface of the hull.

In some embodiments, the at least one buoyant element is a plurality of buoyant elements.

In some embodiments, the at least one outlet is a plurality of outlets distributed along the conduit.

In some embodiments, the at least one hull panel forms a drain for discharging water from the internal volume of the hull.

In some embodiments, the at least one buoyant element is disposed in a lower portion of the internal volume; and the conduit extends in an upper portion of the internal volume.

In some embodiments, the conduit extends above the at least one buoyant element.

In some embodiments, the hull further comprises at least one brace member extending within the internal volume and connected to the at least one hull panel to reinforce the hull.

In some embodiments, the conduit is supported by the at least one brace member.

In some embodiments, the conduit is a tubular member.

In some embodiments, the conduit is a flexible hose.

In some embodiments, the inlet connector is fixed to an outer surface of one of the deck and the hull.

In some embodiments, the hull has a length measured between a front end and a rear end of the hull; and the conduit extends substantially along the length of the hull.

In some embodiments, the hull is a first lateral hull; the watercraft further comprises a second lateral hull laterally spaced apart from the first lateral hull, the second lateral hull supporting the deck, the second lateral hull being an unsealed hull that is permeable such that, in use, water flows at least partly into an internal volume of the second lateral hull; the second lateral hull comprises: at least one hull panel having an inner panel surface and an outer panel surface, the outer panel surface defining at least in part an outer surface of the second lateral hull, the inner panel surface at least partially defining the internal volume of the second lateral hull, the internal volume of the second lateral hull extending beneath the deck; and at least one buoyant element disposed within the internal volume of the second lateral hull; each of the first lateral hull and the second lateral hull has a length; and the conduit extends between the first and second lateral hulls and substantially along the length of each of the first and second lateral hulls.

In some embodiments, the watercraft further comprises a central hull disposed between the first and second lateral hulls; and the conduit extends through the central hull.

According to another aspect of the present technology, there is provided a hull assembly for a watercraft. The hull assembly comprises: a hull configured to support a deck of the watercraft, the hull being an unsealed hull that is permeable such that, in use, water flows at least partly into an internal volume of the hull, the hull comprising: at least one hull panel having an inner panel surface and an outer panel surface, the outer panel surface defining at least in part an outer surface of the hull, the inner panel surface at least partially defining the internal volume of the hull; and at least one buoyant element disposed within the internal volume of the hull; a conduit extending within the internal volume of the hull, the conduit defining at least one outlet for discharging water therethrough, the conduit comprising an inlet connector configured to be connected to an external water source in order to supply water to the conduit. In response to the external water source being connected to the inlet connector, water flows through the conduit, out of the at least one outlet of the conduit, and onto at least a portion of at least one of the inner panel surface and the at least one buoyant element for rinsing thereof.

In some embodiments, the at least one hull panel is a plurality of hull panels connected to one another to form the outer surface of the hull.

In some embodiments, the at least one buoyant element is a plurality of buoyant elements.

In some embodiments, the at least one outlet is a plurality of outlets distributed along the conduit.

In some embodiments, the at least one hull panels forms a drain for discharging water from the internal volume of the hull.

In some embodiments, the at least one buoyant element is disposed in a lower portion of the internal volume; and the conduit extends in an upper portion of the internal volume.

In some embodiments, the conduit extends above the at least one buoyant element.

In some embodiments, the hull further comprises at least one brace member extending within the internal volume and connected to the at least one hull panel to reinforce the hull.

In some embodiments, the conduit is supported by the at least one brace member.

In some embodiments, the conduit is a tubular member.

In some embodiments, the conduit is a flexible hose.

In some embodiments, the inlet connector is fixed to an outer surface of the hull.

In some embodiments, the hull has a length measured between a front end and a rear end of the hull; and the conduit extends substantially along the length of the hull.

In some embodiments, the hull comprises a first lateral hull and a second lateral hull laterally spaced apart from the first lateral hull; each of the first lateral hull and the second lateral hull has a length; and the conduit extends between the first and second lateral hulls and substantially along the length of each of the first and second lateral hulls.

In some embodiments, the hull further comprises a central hull disposed between the first and second lateral hulls; and the conduit extends through the central hull.

According to another aspect of the present technology, there is provided a watercraft. The watercraft comprises: a deck; a hull supporting the deck, the hull being an unsealed hull that is permeable such that, in use, water flows at least partly into an internal volume of the hull, the hull comprising: at least one hull panel having an inner panel surface and an outer panel surface, the outer panel surface defining at least in part an outer surface of the hull, the inner panel surface at least partially defining the internal volume of the hull, the internal volume extending beneath the deck; and at least one buoyant element disposed within the internal volume of the hull; and at least one removable panel comprised by one of the deck and the hull, the at least one removable panel being removable to provide access to at least one of the inner panel surface and the at least one buoyant element.

In some embodiments, the at least one hull panel comprises a plurality of hull panels, the at least one removable panel being one of the hull panels of the plurality of hull panels.

In some embodiments, the at least one removable panel is at least one removable deck panel comprised by the deck.

In some embodiments, the at least one removable panel is toollessly removable from the one of the deck and the hull.

In some embodiments, the at least one hull panel is a plurality of hull panels connected to one another to form the outer surface of the hull.

In some embodiments, the at least one buoyant element is a plurality of buoyant elements.

In some embodiments, the at least one hull panel forms a drain for discharging water from the internal volume of the hull.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
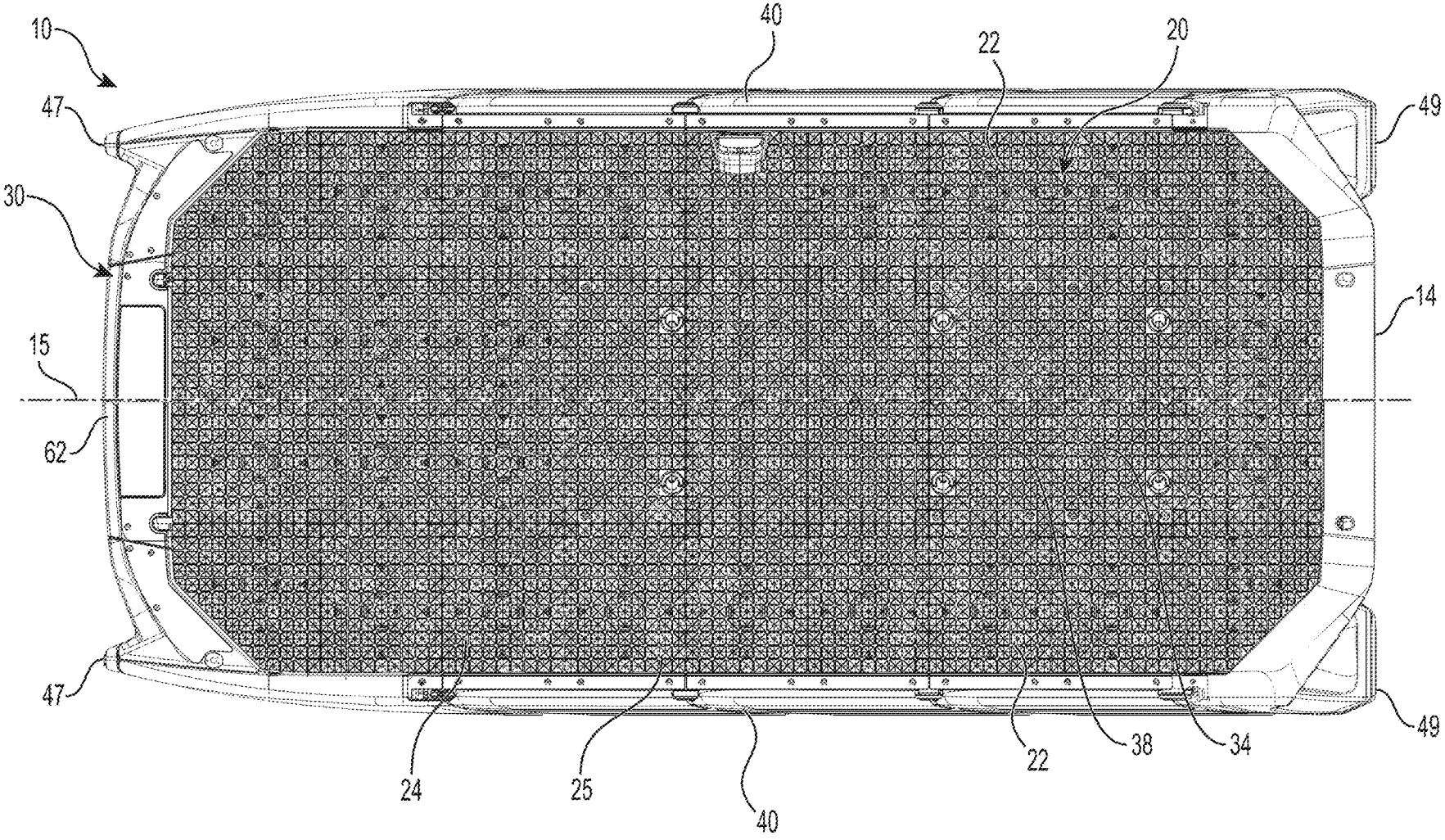
FIG. 1 is a top plan view of a boat in accordance with an embodiment of the present technology.

A watercraft 10 in accordance with one embodiment of the present technology is shown in FIGS. 1 to 5. The following description relates to one example of a watercraft 10, notably a pontoon boat 10. Those of ordinary skill in the art will recognize that there are other known types of watercrafts incorporating different designs and that the present technology would encompass these other watercrafts.

In this embodiment, the boat 10 is a multihull watercraft, notably having a central hull 30 and two lateral hulls 40, namely a port side hull 40 and a starboard side hull 40 (which may also be referred to as the left and right hulls 40). The central hull 30 and the lateral hulls 40 extend longitudinally along the boat 10. The port and starboard side hulls 40 are laterally spaced apart from one another and are separated by the central hull 30 that is laterally centered therebetween and to which both the port and starboard side hulls 40 are connected. As such, in this embodiment, the boat 10 has three hulls. It is contemplated that, in other embodiments, the boat 10 may have a different number of hulls (e.g., a single hull, two hulls, or more than three hulls).

The central hull 30 and the left and right hulls 40 define two tunnels 50 therebetween. Each tunnel 50 extends longitudinally along the boat 10. Notably, a port side tunnel 50 is defined between the port side hull 40 and the central hull 30, while a starboard side tunnel 50 is defined between the starboard side hull 40 and the central hull 30. The left and starboard side tunnels 50 are disposed on opposite sides of a longitudinal centerline 15 of the boat 10.

Figure 3:
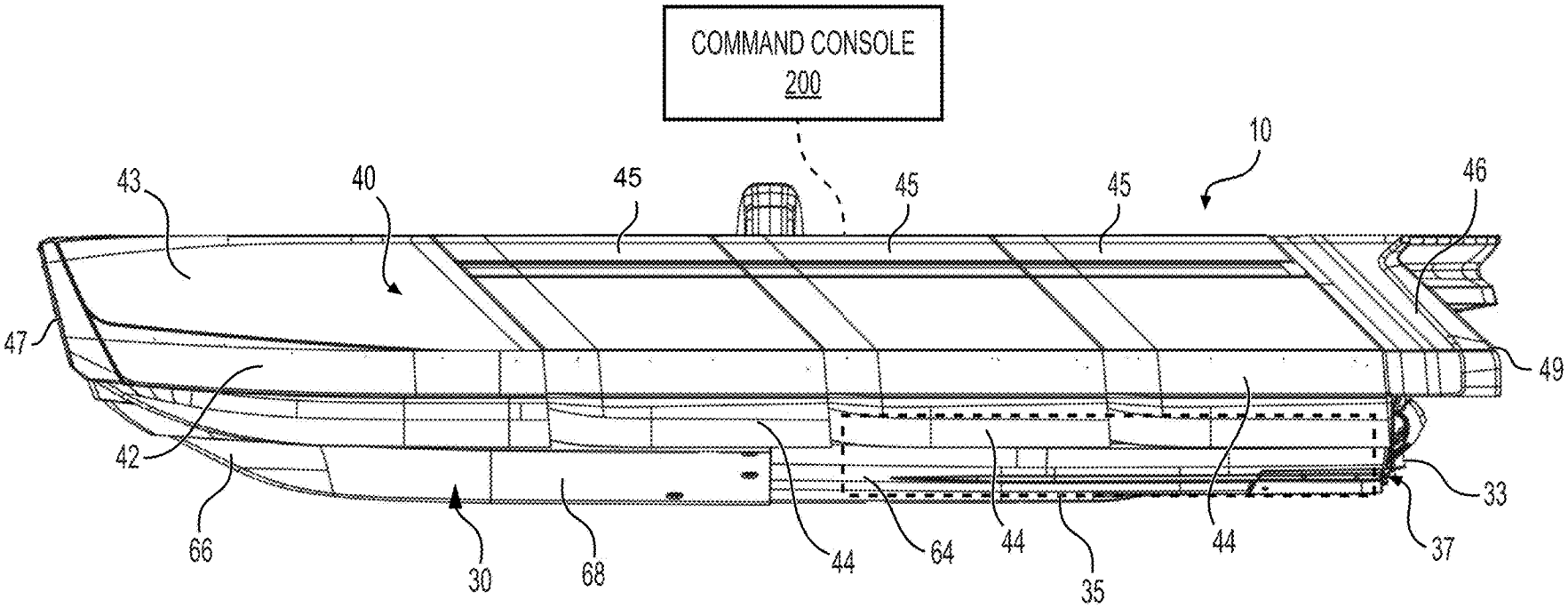
FIG. 3 is a left side elevation view of the boat of FIG. 1.

A deck 20 extends above the left hull 40, the right hull 40 and the central hull 30 and is supported thereby. As shown in FIG. 1, the deck 20 has an upper surface 24 for supporting occupants, as well as accessories and accommodations of the boat 10 (e.g., seating, storage, etc.) that are well known in the art and have been omitted for clarity. For instance, FIG. 3 shows a schematic illustration of a command console 200 supported by the deck 20 and includes vessel controls, such as steering and throttle controls, amongst others. In this embodiment, the deck 20 includes a plurality of tiles 22 which are configured for attachment of accessories thereto. The tiles 22 form a portion of the upper surface 24 of the deck 20. Notably, a number of the tiles 22 extend over the left hull 40, some over the right hull 40 and some others over the central hull 30.

The tiles 22 can have various shapes in accordance with their position on the deck 20. For instance, as can be seen in FIG. 1, some of the tiles 22 along the periphery of the deck 20 are triangular to conform to an angular shape of the periphery of the boat 10. In other cases, some of the tiles 22 are generally rectangular. Each of the tiles 22 has a gripping texture 25 formed on its upper surface 23. In this embodiment, the gripping texture 25 consists of a repeating triangular pattern. The gripping texture 25 may have a different pattern in other embodiments. A more detailed description of the configuration of the tiles 22 and the manner in which they are used for attachment of accessories can be found in U.S. patent application Ser. No. 16/887,481, filed May 29, 2020, which is incorporated herein by reference.

It is contemplated that the deck 20 could have a different construction than that provided by the tiles 22. For instance, the deck 20 could have a more conventional construction such as including a metallic frame and an overlying flooring layer, such as wooden panels, plywood or fiberglass.

A power pack 35 of the boat 10 (schematically illustrated in FIG. 3), including a jet propulsion system 37 and a motor (not shown), is enclosed in part and supported by the central hull 30. A central hull cover 34 (FIG. 1) overlies the powerpack 35 to partly enclose the powerpack 35 between the central hull 30 and the central hull cover 34. An upper surface 38 of the central hull cover 34 is contiguous with the upper surface 24 of the deck 20. The boat 10 is propelled by the jet propulsion system 37 powered by the motor. As shown in FIG. 3, the jet propulsion system 37 has a steering nozzle 33 used for steering the boat 10. A handlebar (not shown) is operatively connected to the steering nozzle 33. A throttle lever (not shown) is operatively connected to the motor for controlling operation of the motor. The handlebar and the throttle lever are located on the command console 200 provided on the deck 20. It is contemplated that other propulsion systems, such as a stern drive, an inboard engine or a marine outboard engine, may be used to propel the boat 10. It is also contemplated that the handlebar could be replaced by a steering wheel and that the steering nozzle 33 could be replaced by an outdrive or one or more rudders.

In this embodiment, the central hull 30 and the lateral hulls 40 of the boat 10 are constructed modularly so as to simplify the production and assembly of various length hulls based on common components. More specifically, the central hull 30 and the lateral hulls 40 of the boat 10 are assembled from a plurality of "modules", the number of which determines the length of each hull 30, 40. A detailed description of the construction of the central hull 30 and the lateral hulls 40 is provided, respectively, in U.S. patent application Ser. No. 17/039,625, and U.S. patent application Ser. No. 17/038,662, both filed on Sep. 30, 2020, the entirety of each of which is incorporated by reference herein. A brief description of the central hull 30 and lateral hulls 40 will thus be provided herein. It is contemplated that, in other embodiments, the central hull 30 and the lateral hulls 40 may not be constructed modularly but may instead each consist of one integral component.

Figure 2:
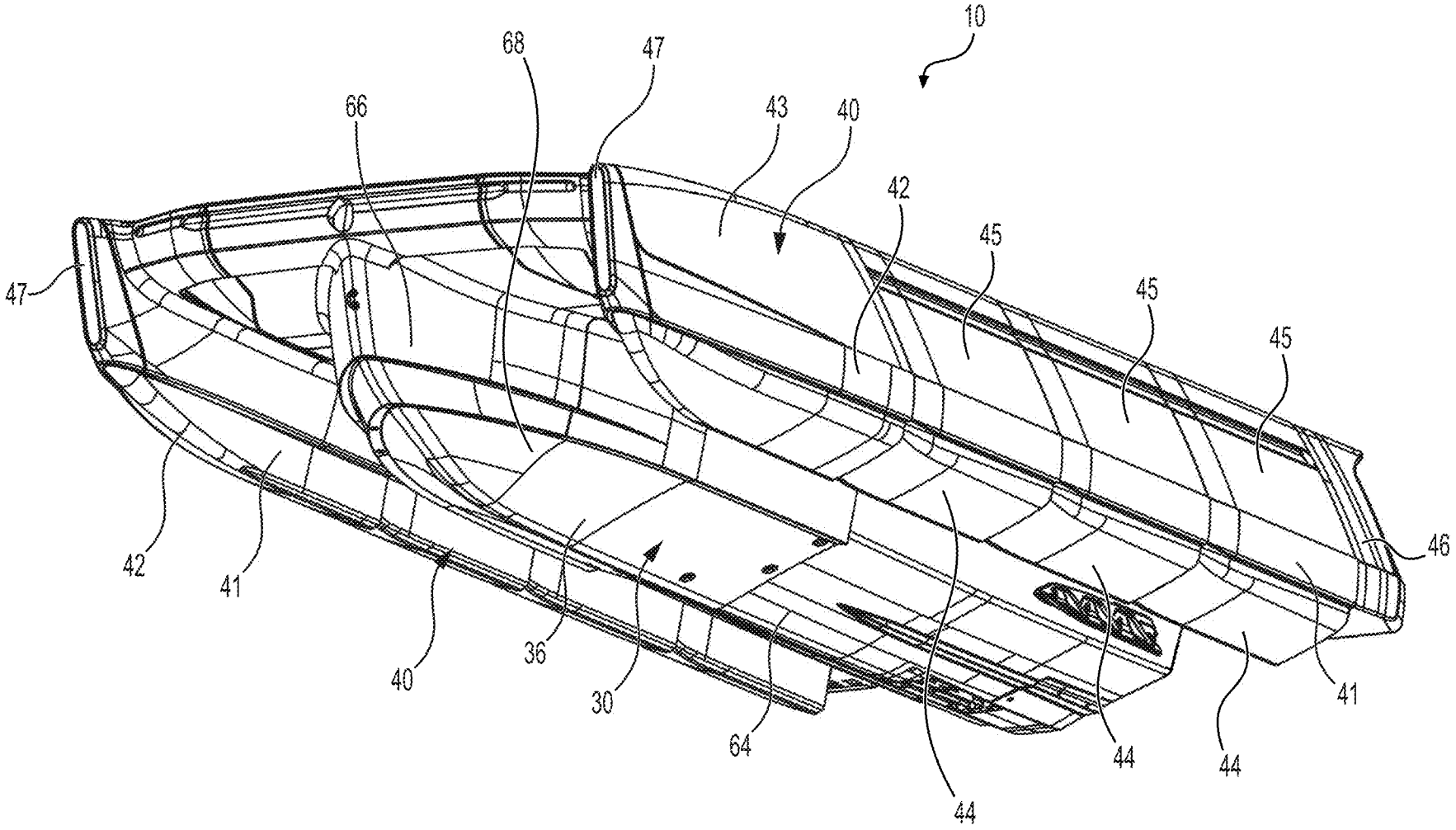
FIG. 2 is a perspective view, taken from a bottom, front, left side, of the boat of FIG. 1.
Figure 4:
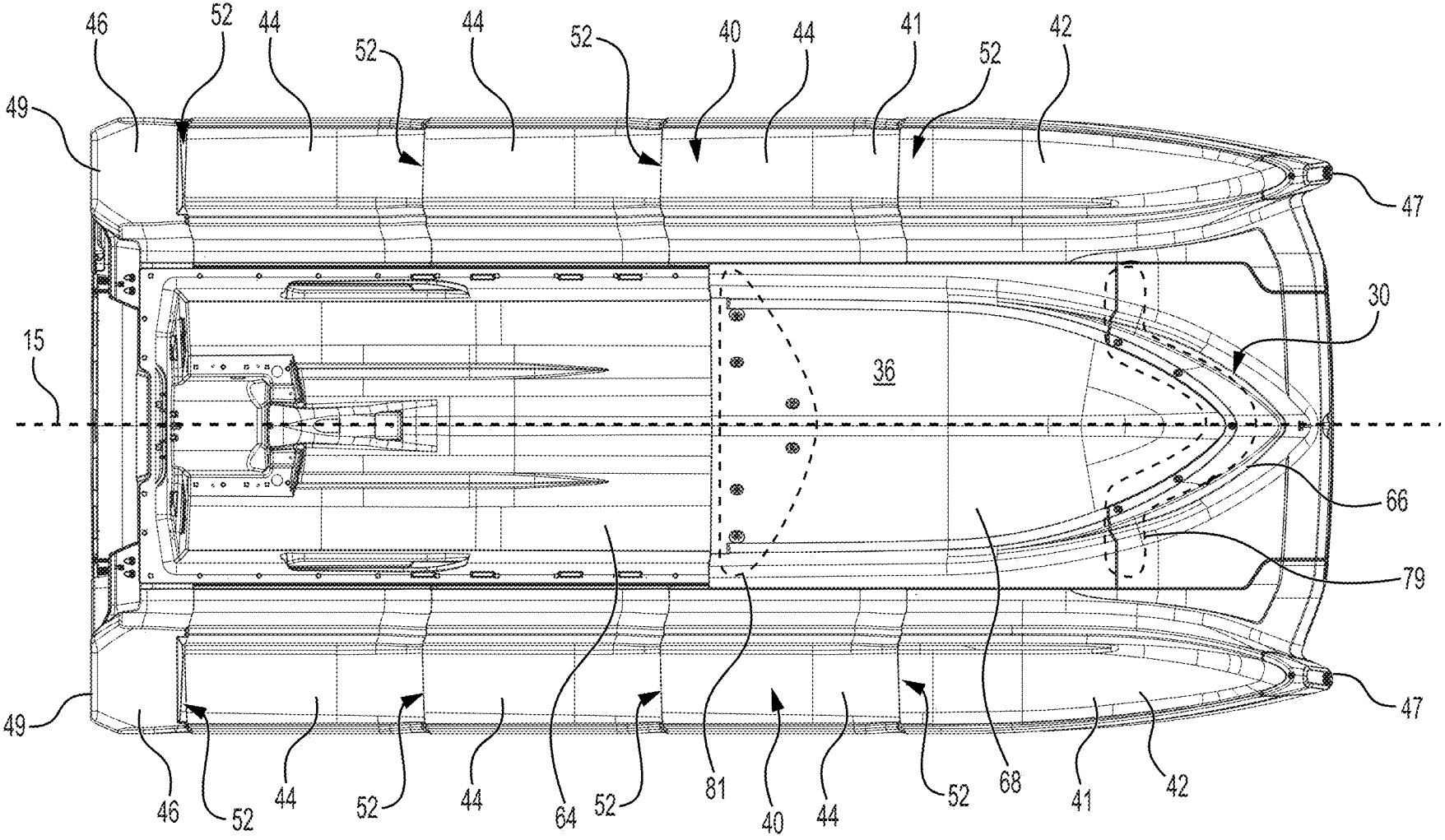
FIG. 4 is a bottom plan view of the boat of FIG. 1.

With reference to FIGS. 2 to 4, in this embodiment, the central hull 30 includes a rear hull panel 64, a front hull panel 66 and an intermediate hull panel 68 that are connected to one another to form inner and outer surfaces of the central hull 30. With additional reference to FIG. 6, the inner surfaces of the hull panels 64, 66, 68 define in part an internal volume 70 of the central hull 30, extending beneath the deck 20. The outer surfaces of the hull panels 64, 66, 68 form an outer surface 36 of the central hull 30. The powerpack 35 of the boat 10 is contained within the internal volume 70 of the central hull 30, namely in a rear portion 71 of the internal volume 70 defined by the rear hull panel 64. A front portion 73 of the internal volume 70 is defined by the front and intermediate hull panels 66, 68.

The two separate portions 71, 73 of the internal volume 70 are not in communication with one another (i.e., the rear portion 71 is closed off from the front portion 73). In fact, the rear portion 71 is closed off entirely from the remainder of the central hull 30 and sealed via a gasket (not shown) to the cover 34 thereabove. On the other hand, an interface 79 between the front and intermediate hull panels 66, 68 and an interface 81 between the rear and intermediate hull panels 64, 68 consists of overlapped sections of the respective panels, the overlapped sections being mechanically fastened to one another (e.g., by bolts). No seals are provided at either of the interfaces 79, 81. While this provides for a simple assembly of the central hull 30, it also makes the central hull 30 permeable since water can enter the front portion 73 of the internal volume 70 through the interfaces 79, 81.

Figure 6:
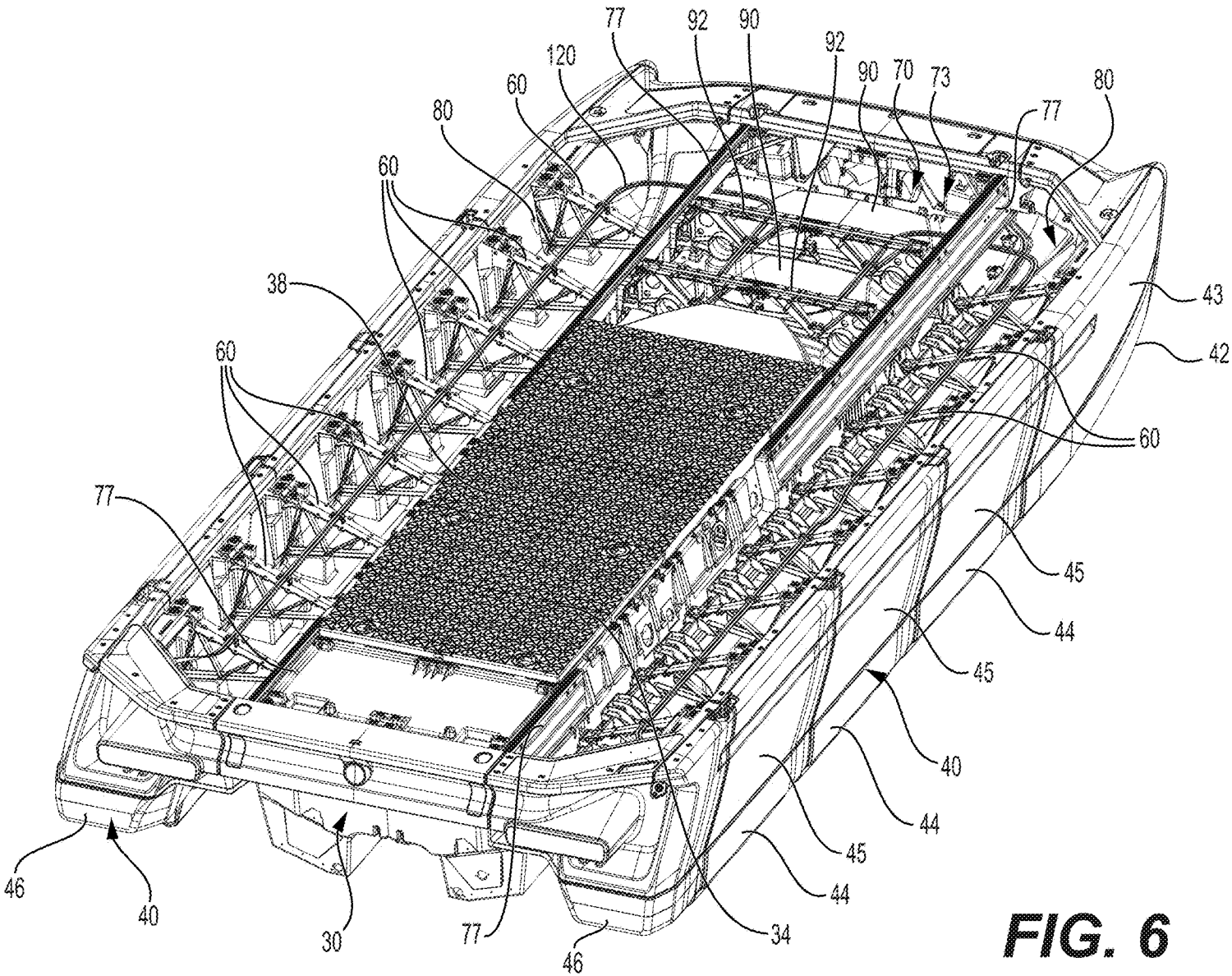
FIG. 6 is a perspective view, taken from a top, rear, right side, of part of the boat of FIG. 1, with part of a deck thereof removed.
Figure 7:
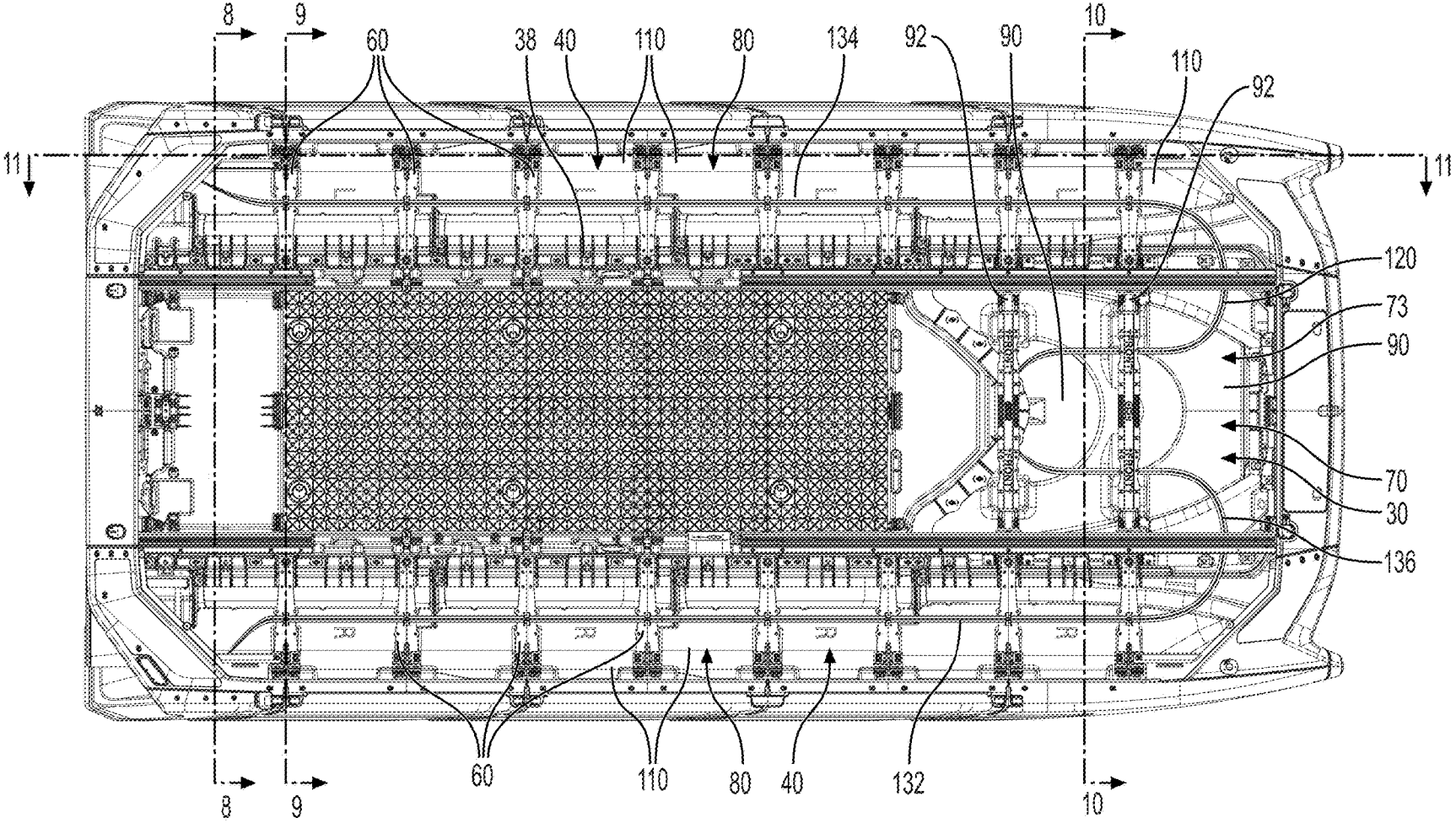
FIG. 7 is top plan view of the part of the boat of FIG. 6.
Figure 8:
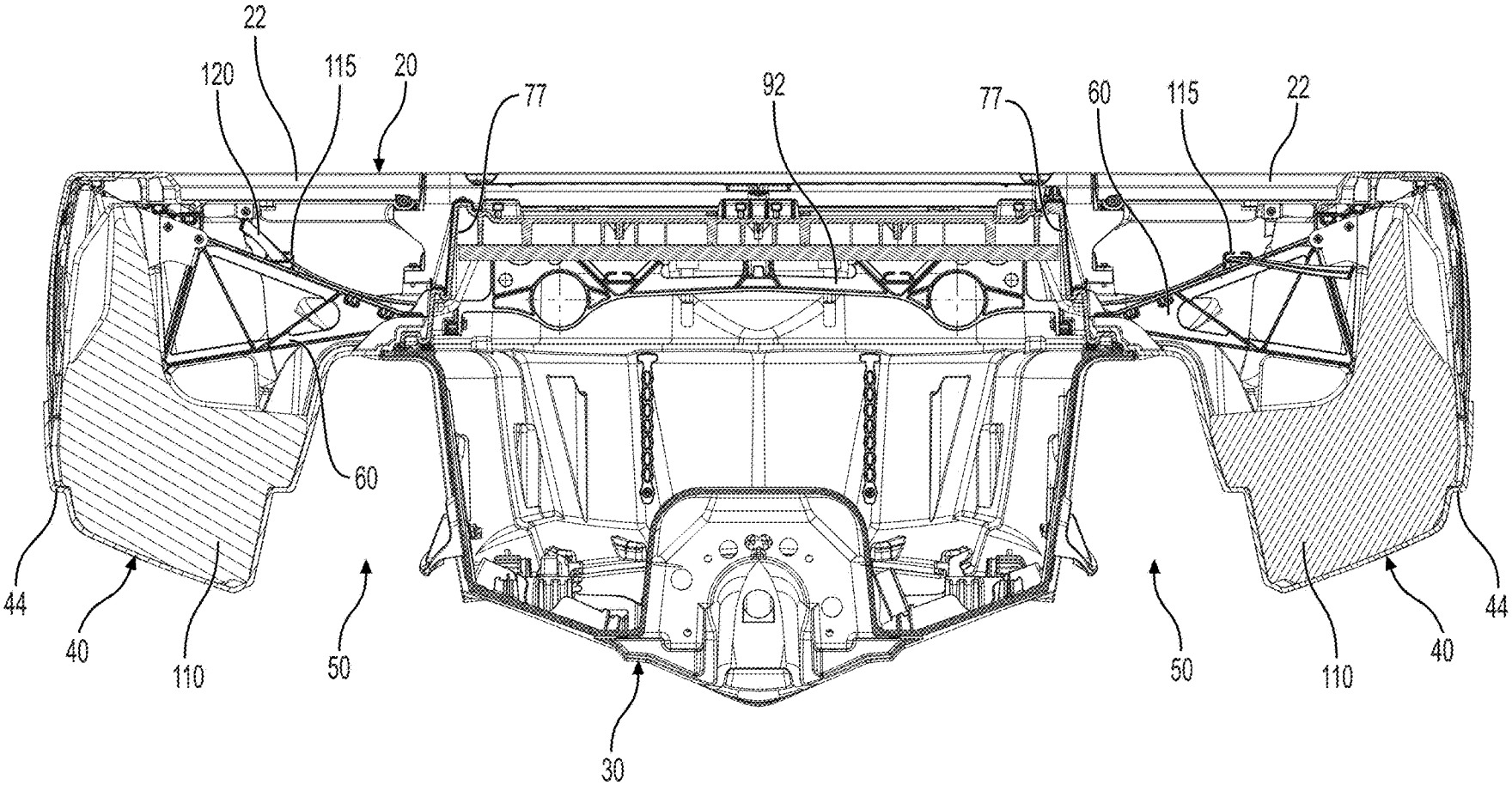
FIG. 8 is a cross-sectional view of the part of the boat of FIG. 6 taken along line 8-8 in FIG. 7.
Figure 10:
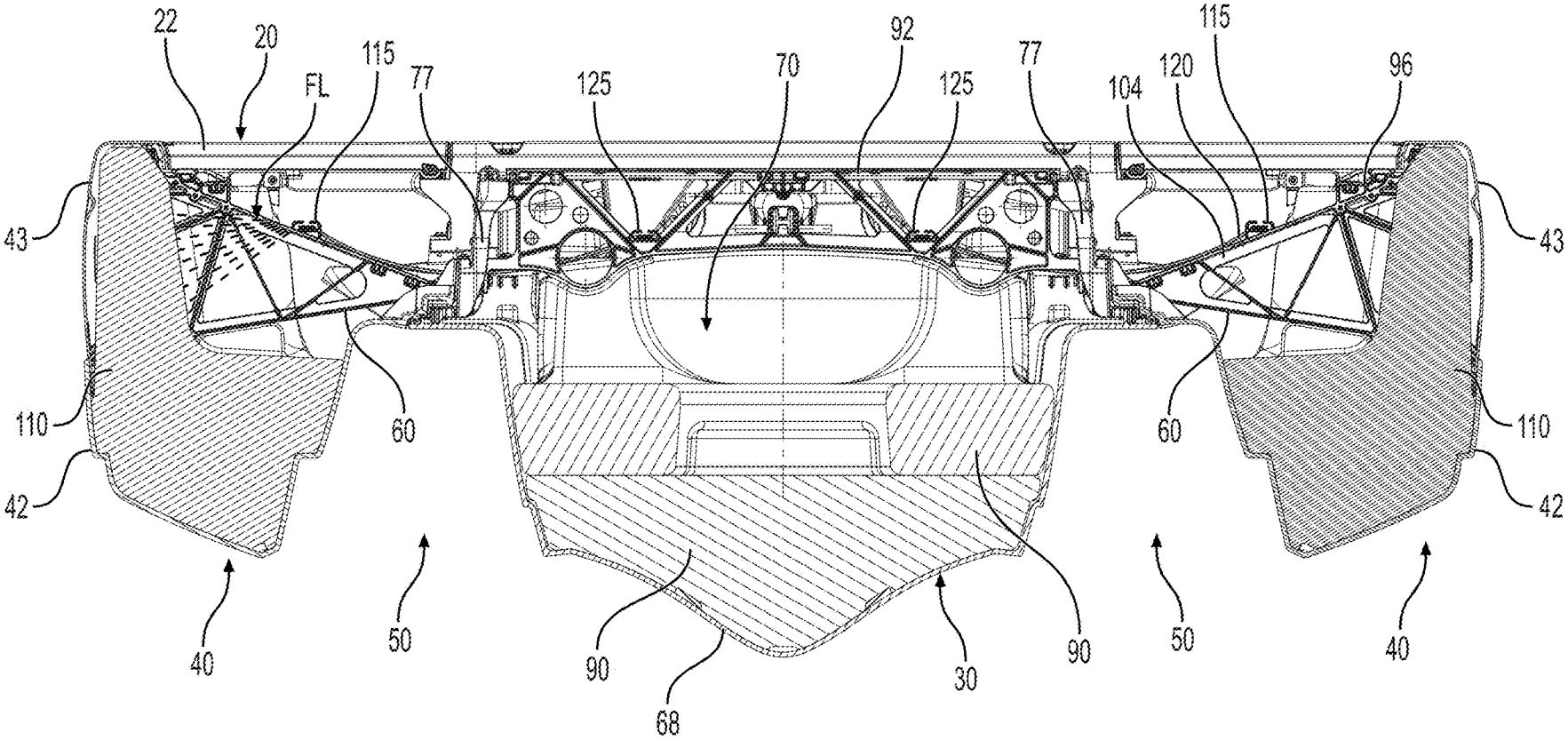
FIG. 10 is a cross-sectional view of the part of the boat of FIG. 6 taken along line 10-10 in FIG. 7.

In order to provide buoyancy to the central hull 30, as partially shown in FIGS. 6, 7 and 10, a plurality of buoyant elements 90 are contained within the front portion 73 of the internal volume 70, shaped to conform to the inner surfaces of the front and intermediate hull panels 66, 68. In this embodiment, the buoyant elements 90 are made of closed-cell foam material and may thus be referred to as "foam blocks". It is contemplated that the buoyant elements 90 could be made of any other suitable foam material in other embodiments. Furthermore, it is also contemplated that the buoyant elements 90 could consist of other types of buoyant elements in other embodiments (e.g., inflatable bladders, plastic containers, etc.).

As shown in FIGS. 6 to 10, the central hull 30 also includes a plurality of brace members 92 extending generally laterally and which are longitudinally spaced from one another. The brace members 92 are connected to respective ones of the rear, front and intermediate hull panels 64, 66, 68 to provide rigidity to the central hull 30 and form part of a central frame comprising the central hull 30. Furthermore, the central hull cover 34 includes vertical wall members 77 that extend downward on either lateral side thereof and are connected to the rear hull panel 64. The vertical wall members 77 support the tiles 22 of the deck 20 that extend thereabove.

In this embodiment, the lateral hulls 40 are mirror images of one another about a vertical plane passing through the longitudinal centerline 15 of the boat 10 and therefore only one of the lateral hulls 40 will be described in detail herein. With reference to FIGS. 1 to 3, in this embodiment, the lateral hull 40 includes a lower front hull panel 42, an upper front hull panel 43, three lower hull panels 44, three side hull panels 45 and a rear hull panel 46 that are connected to one another to form the inner and outer surfaces of the lateral hull 40. The lower front hull panel 42 and the rear hull panel 46 respectively define the front and rear ends of the lateral hull 40. The lower hull panels 44 and the side hull panels 45 are disposed between the lower and upper front hull panels 42, 43 and the rear hull panel 46 and therefore may be referred to as intermediate hull panels 44, 45. The inner surfaces of the hull panels 42, 43, 44, 45, 46 define in part the internal volume 80 of the lateral hull 40, extending beneath the deck 20. The outer surfaces of the hull panels 42, 43, 44, 45, 46 form an outer surface 41 of the lateral hull 40.

The hull panels 42, 43, 44, 45, 46 of the lateral hull 40 are connected to one another at respective interfaces 52 therebetween. The interfaces 52 between the hull panels 42, 43, 44, 45, 46 consists of overlapped sections of the respective panels, the overlapped sections being mechanically fastened to one another (e.g., by bolts) or interlocked with one another. No seals are provided at the interfaces 52. Similarly to the construction of the central hull 30, while this provides for a simple assembly of the lateral hull 40, it also makes the lateral hull 40 permeable since water can enter the internal volume 80 through the interfaces 52.

Figure 11:
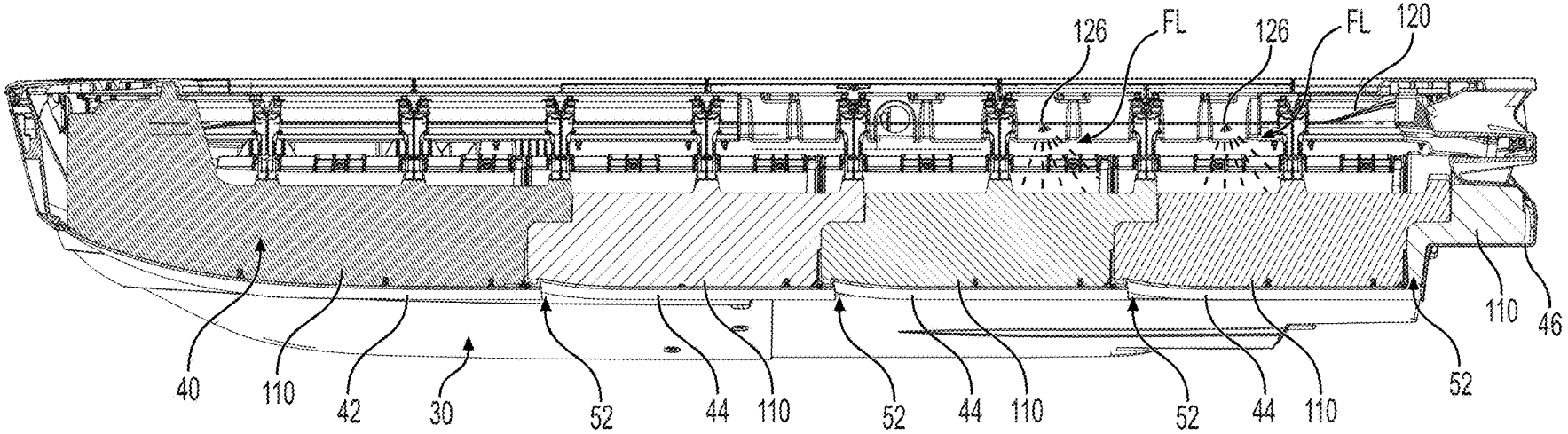
FIG. 11 is a cross-sectional view of the part of the boat of FIG. 6 taken along line 11-11 in FIG. 7.

In order to provide buoyancy to the lateral hull 40, as shown in FIGS. 6 to 11, the lateral hull 40 also has a plurality of buoyant elements 110 disposed within the lower front hull panel 42, the lower hull panels 44 and the rear hull panel 46 to provide buoyancy to the lateral hull 40. In this embodiment, the buoyant elements 110 are made of closed-cell foam material and may thus be referred to as "foam blocks". It is contemplated that the buoyant elements 110 could be made of any other suitable foam material in other embodiments. Furthermore, it is also contemplated that the buoyant elements 110 could consist of other types of buoyant elements in other embodiments (e.g., inflatable bladders, plastic containers, etc.). As shown in FIGS. 6 and 11, the buoyant elements 110 are shaped and sized to conform to the inner surfaces of the hull panels 42, 43, 44, 45, 46.

Figure 9:
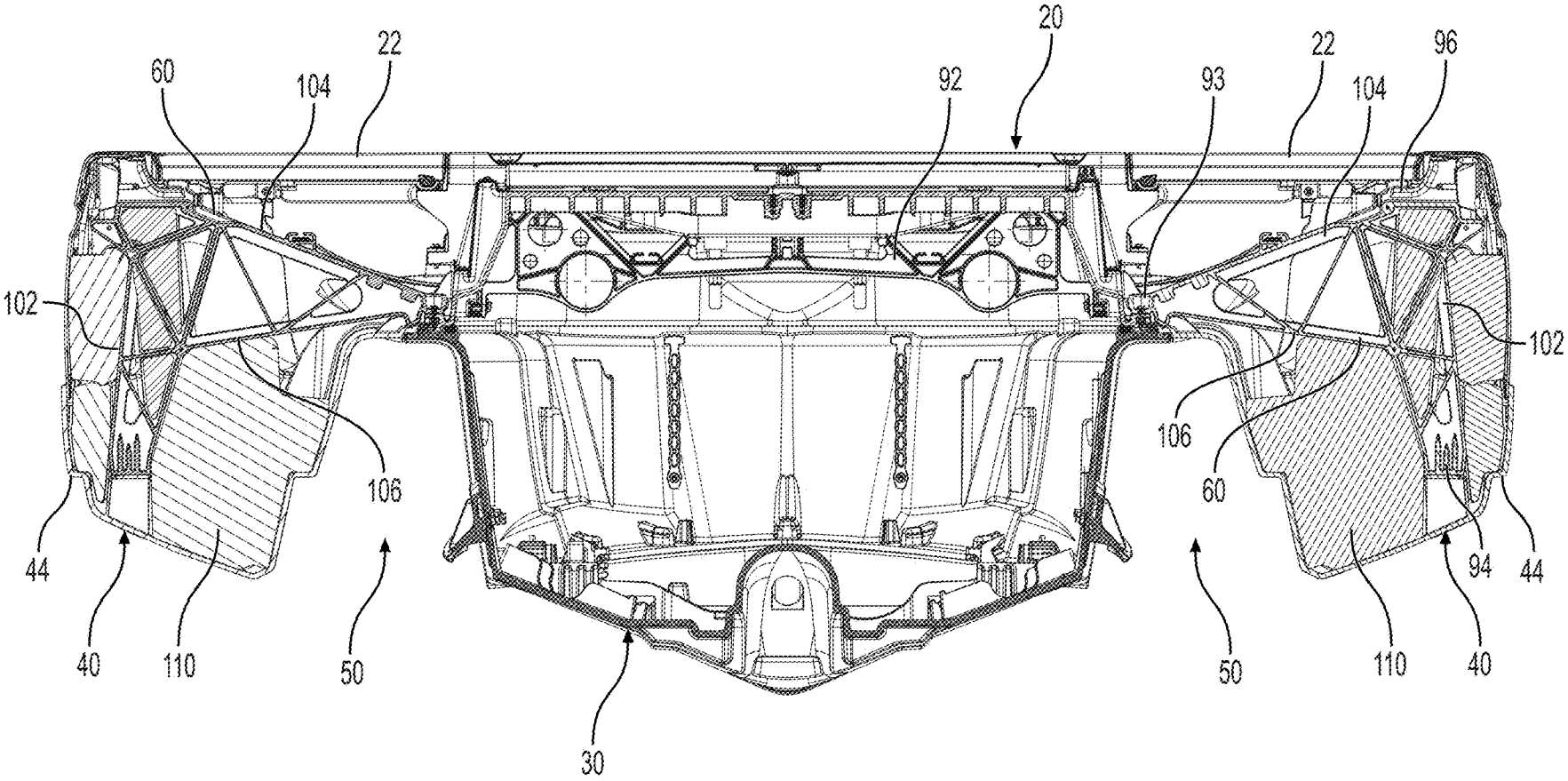
FIG. 9 is a cross-sectional view of the part of the boat of FIG. 6 taken along line 9-9 in FIG. 7.

As shown in FIG. 6, each lateral hull 40 has a plurality of brace members 60 configured for reinforcing the lateral hull 40 so as to support loads exerted thereon. The brace members 60 are longitudinally spaced apart from one another, each being connected between the central hull 30, the deck 20 and a corresponding one of the lower front hull panel 42, the lower hull panels 44 and the rear hull panel 46. In particular, as best shown in FIG. 9, each brace member 60 has a laterally inner mount 93 connected to the central hull 30, a lower mount 94 connected to any one of the lower front hull panel 42, the lower hull panels 44 and the rear hull panel 46, and an upper mount 96 connected to the deck 20. The brace members 60 are disposed in recesses defined by the buoyant elements 110 such that the buoyant elements 110 are shaped to accommodate the brace members 60.

As shown in FIG. 9, in this embodiment, each brace member 60 has three beam portions 102, 104, 106 that extend substantially linearly, namely an upstanding beam portion 102, an upper beam portion 104 and a lower beam portion 106. The upstanding beam portion 102 extends between the upper mount 96 and the lower mount 94 and thus extends generally vertically. The upper beam portion 104 extends between the inner mount 93 and the upper mount 96. The lower beam portion 106 extends between the inner mount 93 and the upstanding beam portion 102. This configuration of the beam portions 102, 104, 106 provides support for the lateral hull 40 while simultaneously remaining compact so as to adapt to the limited space available within the lateral hull 40. The brace members 60 may be configured differently in other embodiments.

As mentioned above, due to their construction of interconnected hull panels which are partially overlapped, with the interfaces therebetween being unsealed, the central and lateral hulls 30, 40 are unsealed hulls that are permeable such that, in use, water flows at least partly into the internal volumes 70, 80 thereof. Therefore, during use, it is possible that contaminants such as aquatic invasive species (AIS) could enter into the internal volumes 70, 80 of the hulls 30, 40 and be deposited on the inner surfaces of the hulls 30, 40, including the inner surfaces of the hull panels and the buoyant elements. To address this, in this embodiment, as shown in FIGS. 6 and 7, the boat 10 includes a conduit 120 that extends within the central and lateral hulls 30, 40 in order to provide a convenient and expeditious manner to rinse the inner surfaces of the hulls 30, 40. Notably, as will be described below, the conduit 120 extends within the internal volumes 70, 80 of the hulls 30, 40 and exposes the inner surfaces thereof to water discharged by the conduit 120.

Figure 13:
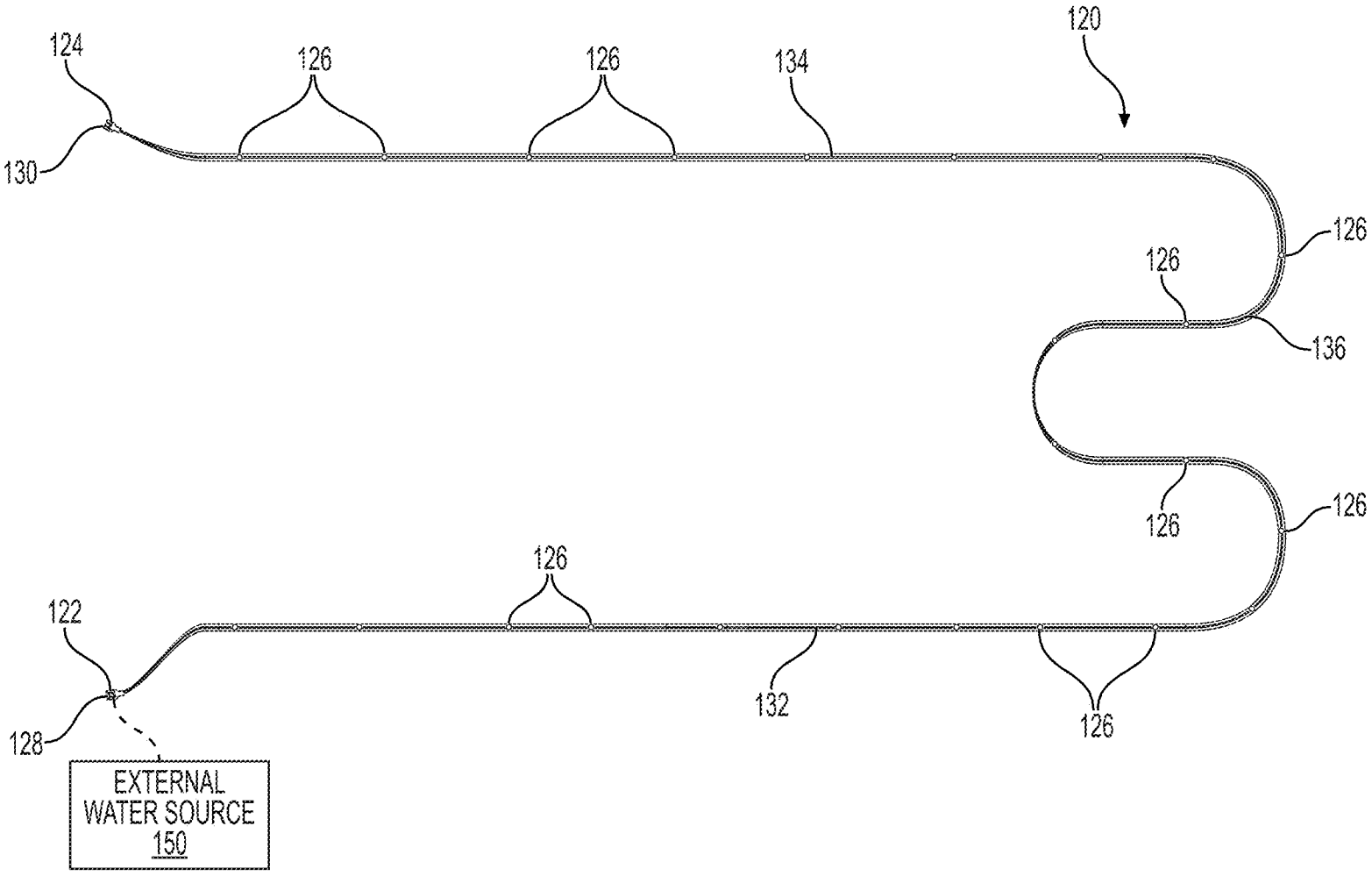
FIG. 13 is a top plan view of a conduit of the boat of FIG. 1.

With reference to FIG. 13, in this embodiment, the conduit 120 extends from a first end 122 to a second end 124 to form a continuous path for water flow therein. The conduit 120 has an inlet connector 128 at the first end 122 configured to be connected to an external water source 150 in order to supply water to the conduit 120. The external water source 150 may be a faucet fed by a water supply. The conduit 120 also defines a plurality of outlets 126 through which water is discharged from the conduit 120. At the second end 124 of the conduit 120, a stopper 130 is provided such that water does not flow out or into the conduit 120 through the second end 124.

Figure 5:
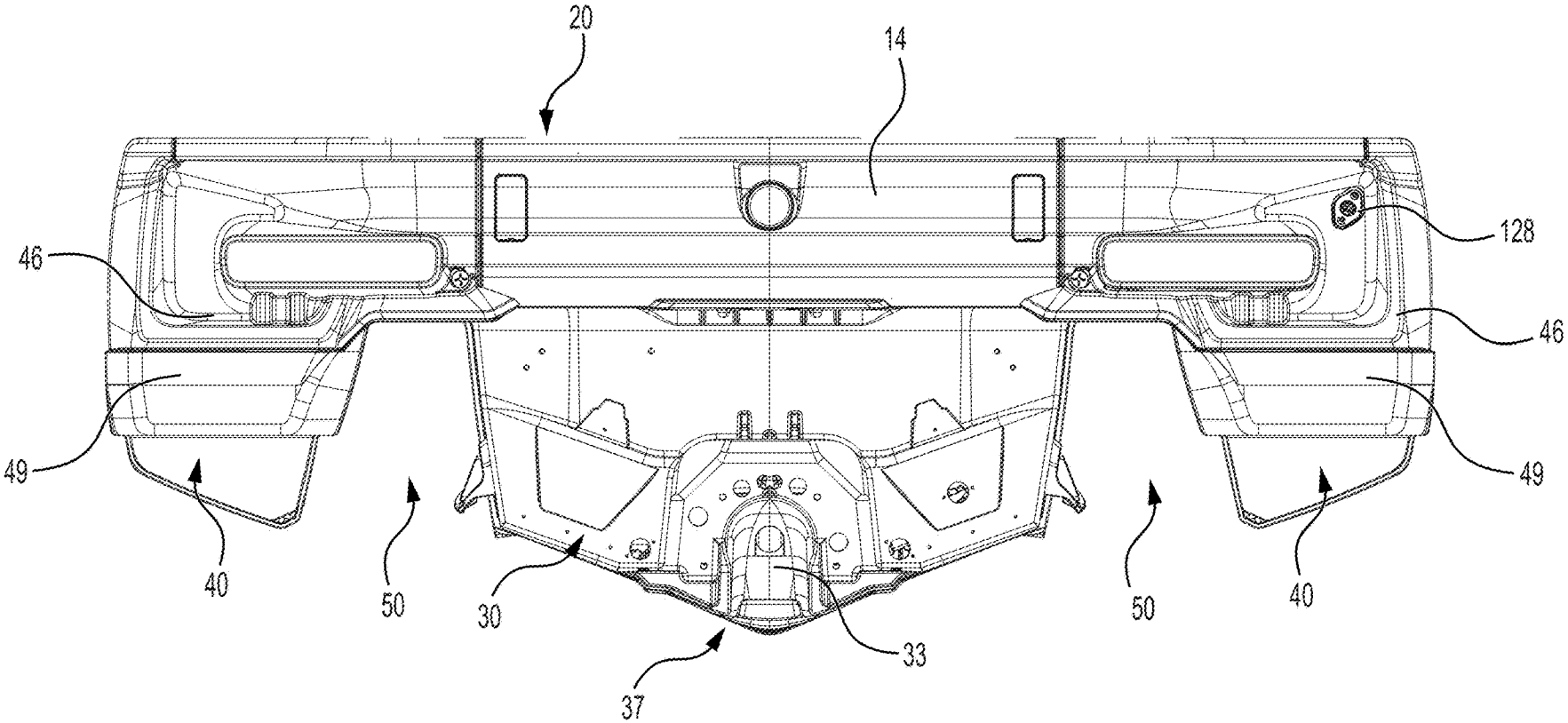
FIG. 5 is a rear elevation view of the boat of FIG. 1.

The inlet connector 128 is configured to connect a hose which can be fluidly connected to the external water source 150. To that end, the inlet connector 128 comprises a quick-connect feature to facilitate connection to a hose which has a corresponding fitting. The inlet connector 128 may be configured differently in other embodiments. For instance, the inlet connector 128 could comprise a threaded fitting to secure a corresponding threaded fitting of the hose. Furthermore, in this embodiment, as shown in FIG. 5, the inlet connector 128 is fixed to an outer surface of the starboard side hull 40. In particular, the inlet connector 128 is fixed to the outer surface of the rear hull panel 46 of the starboard side hull 40. As such, the inlet connector 128 is disposed at a transom 14 of the boat 10. The inlet connector 128 is therefore easily accessible from the exterior of the boat 10. It is contemplated that, in other embodiments, the inlet connector 128 could be provided elsewhere on the boat 10. For instance, in other embodiments, the inlet connector 128 could be fixed to an outer surface of the port side hull 40 or to the central hull 30, or to the outer surface of the deck 20 (e.g., at one of the tiles 22). It is also contemplated that the inlet connector 128 could be concealed by an openable or removable cover.

As shown in FIG. 13, the outlets 126 are distributed along the conduit 120 to discharge water at different points along the hulls 30, 40. Notably, the outlets 126 are distributed along the conduit 120 so as to maximize coverage of the inner surfaces of the hulls 30, 40 by water discharged through the outlets 126. Moreover, the outlets 126 are oriented so that water discharged therethrough rinses the inner surfaces of the hulls 30, 40. For instance, this may include the inner surfaces of the hull panels of the hulls 30, 40, the surfaces of the buoyant elements of the hulls 30, the surfaces of the brace members 60, and the underside of the deck 20. It is to be understood that the outlets 126 are illustrated representatively as an example and that more or fewer outlets could be provided in other embodiments, or that the outlets could be spaced further apart or closer to one another, or that the outlets could be oriented differently.

In this embodiment, the outlets 126 are openings defined by the conduit 120. In other words, the conduit 120 is perforated to form the outlets 126. In other embodiments, the conduit 120 includes outlets 126 defined by nozzles connected to a body of the conduit 120. For instance, in other embodiments, the conduit 120 could comprise sprinklers defining respective ones of the outlets 126. This may allow imparting more directionality to the stream of water discharged by the outlets 126.

Figure 12:
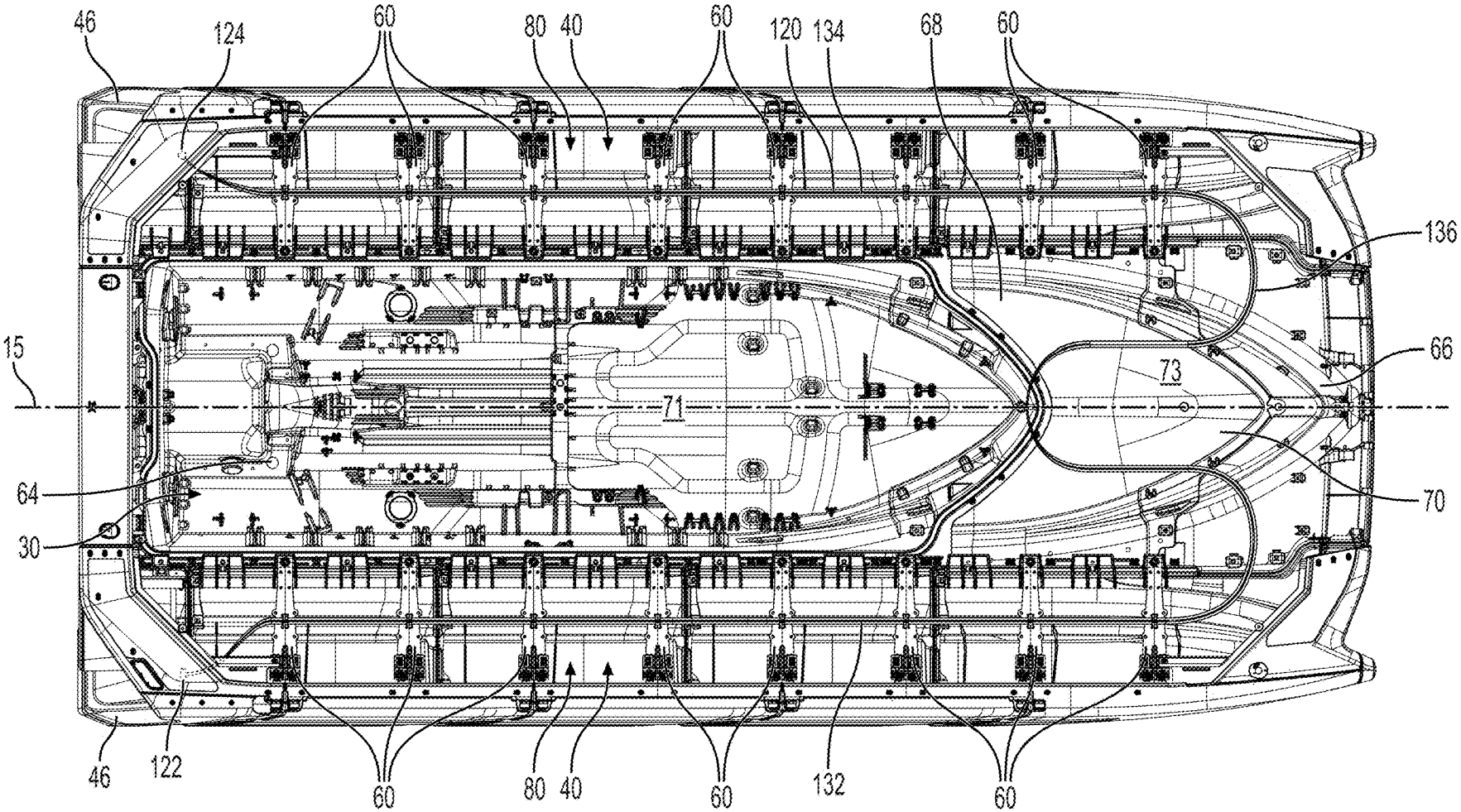
FIG. 12 is a top plan view of part of the boat of FIG. 1, shown with the deck and buoyant elements thereof removed.

As best shown in FIG. 12, the conduit 120 is arranged to extend substantially along the entire length of the boat 10. Notably, the first end 122 is located at the starboard side hull 40 while the second end 124 is located at the port side hull 40. In particular, in this embodiment, the conduit 120 has a starboard section 132 and a port section 134 extending within the internal volumes 80 of the starboard side hull 40 and the port side hull 40, respectively. Each of the starboard section 132 and the port section 134 extends substantially along a length of the respective lateral hull 40 (defined between the front and rear ends 47, 49 thereof). That is, each of the starboard section 132 and the port section 134 extends along at least 70% of the length of the respective lateral hull 40. This may provide greater coverage of the inner surfaces of the lateral hulls 40 by the water discharged through the outlets 126 of the conduit 120.

A central section 136 of the conduit 120 extends between the starboard section 132 and the port section 134. The central section 136 extends within the internal volume 70 of the central hull 30, particularly within the portion of the internal volume 70 defined by the front hull panel 66 and the intermediate hull panel 68. Notably, as the rear hull panel 64 defines a portion of the internal volume 70 of the central hull 30 that is closed off from the environment and from the remainder of the internal volume 70 of the central hull 30, the conduit 120 does not extend into the rear hull panel 64 since the rear hull panel 64 is not permeable. As shown in FIG. 12, in this embodiment, the conduit 120 loops rearward from the starboard section 132 to the central section 136. The conduit 120 then loops forward around a lateral midpoint of the central section 136, and then loops rearward again from the central section 136 to the port section 134.

As shown in FIGS. 8 to 11, the conduit 120 extends in an upper portion of the internal volumes 70, 80 of the hulls 30, 40. Notably, the conduit 120 extends above the buoyant elements 90, 110 of the central and lateral hulls 30, 40 which are disposed in respective lower portions of the internal volumes 70, 80. More specifically, as shown in FIG. 10, the conduit 120 is received and retained by retaining clips 115 provided on the brace members 60 of the lateral hulls 40, particularly on the upper beam portions 104 thereof. Similarly, the conduit 120 is received and retained by retaining clips 125 provided on the brace members 92 of the central hull 30. As such, the conduit 120 is supported by the brace members 60, 92.

In this embodiment, the conduit 120 is a tubular member defining a continuous inner wall within which water flows. More specifically, in this embodiment, the conduit 120 is a flexible hose. This may allow for easy installation of the conduit 120 as its pliability allows it to follow any type of path within the hulls 30, 40. It is contemplated that, in other embodiments, the conduit 120 could be a rigid conduit (e.g., rigid plastic piping). Moreover, in other embodiments, the conduit 120 could be formed by interconnected voids formed within larger components (e.g., the buoyant elements 110). For instance, in some embodiments, an inner tubular frame structure comprising beams disposed below the deck 20 could form the interconnected voids.

The conduit 120 may be configured differently in other embodiments. For instance, it is contemplated that the conduit 120 may not necessarily follow a single continuous path. Notably, in other embodiments, the conduit 120 could have different branches forming distinct paths within which water can flow in parallel to reach different areas of the hulls 30, 40.

Moreover, while in this embodiment a single conduit 120 is provided to rinse the inner surfaces of all three of the hulls 30, 40, it is contemplated that multiple conduits may be provided instead. For instance, in other embodiments, the central hull 30 and the lateral hulls 40 could be provided with respective separate conduits, each one having a corresponding inlet connector.

As can be understood from the above, by providing the conduit 120, the inner surfaces of the hulls 30, 40 can be rinsed to clear off potentially undesirable contaminants therefrom, including for instance AIS that could have clung to those surface. Notably, in response to the external water source 150 being connected to the inlet connector 128 of the conduit 120, water flows through the conduit 120, out of the outlets 126 thereof, and onto at least a portion of the inner panel surfaces of at least some of the inner panel surfaces of the central and lateral hulls 30, 40, as well as onto the buoyant elements 90, 110 of the central and lateral hulls 30, 40 for rinsing thereof. For instance, FIGS. 10 and 11 illustrate a flow FL of water exiting a few of the outlets 126 of the conduit 120 and onto the inner surfaces of the lateral hulls 40 to rinse them off. The hull panels of the hulls 30, 40 form drains, namely at the interfaces 52, 79, 81 between the hull panels which are unsealed, for discharging water from the internal volumes 70, 80 of the hulls 30, 40. Thus, after water is fed into the conduit 120 to rinse off the inner surfaces of the hulls 30, 40, the water is discharged through the interfaces 52, 79, 81 and, with it, contaminants that may have clung onto the inner surfaces of the hulls 30, 40.

Figure 14:
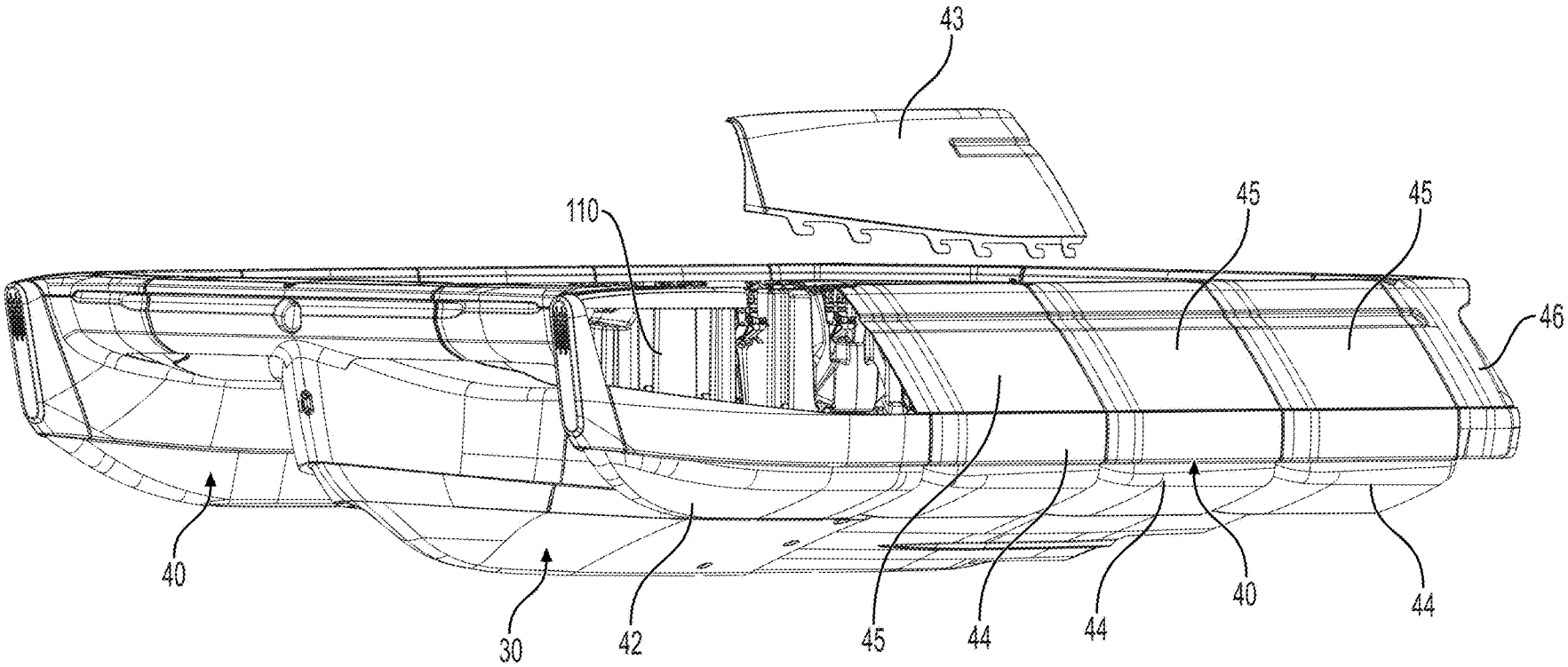
FIG. 14 is a perspective view, taken from a front, left side, of the boat in accordance with an alternative embodiment.

In other embodiments, the boat 10 may be configured to facilitate rinsing of the inner surfaces of the central and lateral hulls 30, 40 without providing the conduit 120. For instance, in an alternative embodiment illustrated in FIGS. 14 and 15, at least one of the upper front hull panels 43 and side hull panels 45 of the lateral hulls 40 is movable by an operator to provide access to the inner panel surfaces of the hull panels 42, 43, 44, 45, 46 and/or the buoyant elements 110 of the lateral hulls 40. For instance, in this alternative embodiment, the upper front hull panels 43 and the side hull panels 45 are removable by the operator. As such, once the removable panels 43, 45 are removed, the operator can rinse the inner surfaces of the lateral hulls 40 with a standard hose. The drains formed at the interfaces 52 between the various hull panels 42, 43, 44, 45, 46 allow the water to be discharged from the internal volumes 80 of the lateral hulls 40.

In this alternative embodiment, the upper front hull panels 43 and the side hull panels 45 are toollessly removable (i.e., do not require any tools for removal thereof) from the lateral hulls 40. Notably, the upper front hull panels 43 and the side hull panels 45 are interlocked with the lower front hull panels 42 and lower hull panels 44 and thus can be removed without using any tools.

Figure 15:
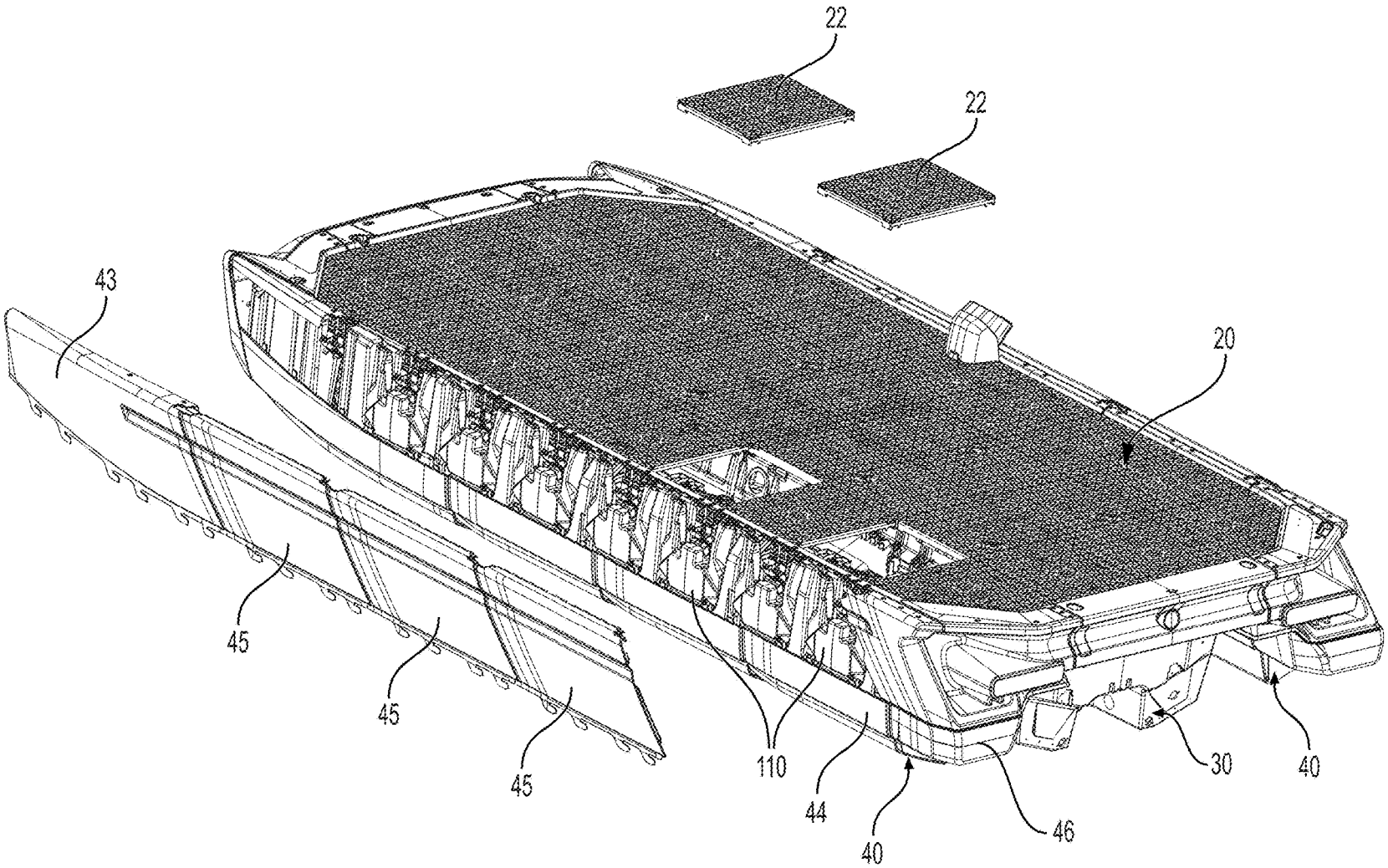
FIG. 15 is a perspective view, taken from a rear, left side, of the boat in accordance with another alternative embodiment.

Furthermore, as shown in FIG. 15, additionally or alternatively, the tiles 22 of the deck 20 may be removable panels that can be removed from the deck 20 to provide access to the inner panel surfaces and the buoyant elements 110 of the lateral hulls 40, thus similarly allowing the operator to rinse the inner surfaces of the lateral hulls 40.

In addition, although not shown, the tiles 22 of the deck 20 overlying the front portion 73 of the internal volume 70 of the central hull 30 may similarly be removable to provide access to the inner panel surfaces and the buoyant elements 90 of the central hull 30, thereby allowing the operator to rinse the inner surfaces of the central hull 30 at the front portion 71.

Alternatively, in other embodiments, some of the hull panels and/or the tiles 22 of the deck 20 could be movable to provide access to the internal volumes of the hulls 30, 40 but remain connected to the boat 10. For instance, the upper front hull panels 43 and the side hull panels 45 of the lateral hulls 40 could be operatively connected (e.g., pivotably connected) to the deck 20 or other hull panels to allow the operator to move the upper front hull panels 43 and the side hull panels 45 between closed and open positions. In their open positions, the upper front hull panels 43 and the side hull panels 45 provide access to the inner panel surfaces of the hull panels 42, 43, 44, 45, 46 and/or the buoyant elements 110 of the lateral hulls 40. Notably, in one example of implementation, the upper front hull panels 43 and the side hull panels 45 of the lateral hulls 40 could be hinged to the deck 20 or other hull panels of the lateral hulls 40.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a deck;

a hull supporting the deck, the hull being an unsealed hull that is permeable such that, in use, water flows at least partly into an internal volume of the hull, the hull comprising:

at least one hull panel having an inner panel surface and an outer panel surface, the outer panel surface defining at least in part an outer surface of the hull, the inner panel surface at least partially defining the internal volume of the hull, the internal volume extending beneath the deck; and at least one buoyant element disposed within the internal volume of the hull; and a conduit extending within the internal volume of the hull, the conduit defining at least one outlet for discharging water therethrough, the conduit comprising an inlet connector configured to be connected to an external water source in order to supply water to the conduit, wherein, in response to the external water source being connected to the inlet connector, water flows through the conduit, out of the at least one outlet of the conduit, and onto at least a portion of at least one of the inner panel surface and the at least one buoyant element for rinsing thereof.

2. The watercraft of claim 1, wherein the at least one hull panel is a plurality of hull panels connected to one another to form the outer surface of the hull.

3. The watercraft of claim 1, wherein the at least one buoyant element is a plurality of buoyant elements.

4. The watercraft of claim 1, wherein the at least one outlet is a plurality of outlets distributed along the conduit.

5. The watercraft of claim 1, wherein the at least one hull panel forms a drain for discharging water from the internal volume of the hull.

6. The watercraft of claim 1, wherein:

the at least one buoyant element is disposed in a lower portion of the internal volume; and the conduit extends in an upper portion of the internal volume.

7. The watercraft of claim 1, wherein the conduit extends above the at least one buoyant element.

8. The watercraft of claim 1, wherein the hull further comprises at least one brace member extending within the internal volume and connected to the at least one hull panel to reinforce the hull.

9. The watercraft of claim 8, wherein the conduit is supported by the at least one brace member.

10. The watercraft of claim 1, wherein the conduit is a tubular member.

11. The watercraft of claim 1, wherein the conduit is a flexible hose.

12. The watercraft of claim 1, wherein the inlet connector is fixed to an outer surface of one of the deck and the hull.

13. The watercraft of claim 1, wherein:

the hull has a length measured between a front end and a rear end of the hull; and the conduit extends substantially along the length of the hull.

14. The watercraft of claim 1, wherein:

the hull is a first lateral hull;

the watercraft further comprises a second lateral hull laterally spaced apart from the first lateral hull, the second lateral hull supporting the deck, the second lateral hull being an unsealed hull that is permeable such that, in use, water flows at least partly into an internal volume of the second lateral hull;

the second lateral hull comprises:

at least one hull panel having an inner panel surface and an outer panel surface, the outer panel surface defining at least in part an outer surface of the second lateral hull, the inner panel surface at least partially defining the internal volume of the second lateral hull, the internal volume of the second lateral hull extending beneath the deck; and at least one buoyant element disposed within the internal volume of the second lateral hull;

each of the first lateral hull and the second lateral hull has a length; and the conduit extends between the first and second lateral hulls and substantially along the length of each of the first and second lateral hulls.

15. The watercraft of claim 14, wherein:

the watercraft further comprises a central hull disposed between the first and second lateral hulls; and the conduit extends through the central hull.

16. A hull assembly for a watercraft, comprising:

a hull configured to support a deck of the watercraft, the hull being an unsealed hull that is permeable such that, in use, water flows at least partly into an internal volume of the hull, the hull comprising:

at least one hull panel having an inner panel surface and an outer panel surface, the outer panel surface defining at least in part an outer surface of the hull, the inner panel surface at least partially defining the internal volume of the hull; and at least one buoyant element disposed within the internal volume of the hull; and a conduit extending within the internal volume of the hull, the conduit defining at least one outlet for discharging water therethrough, the conduit comprising an inlet connector configured to be connected to an external water source in order to supply water to the conduit, wherein, in response to the external water source being connected to the inlet connector, water flows through the conduit, out of the at least one outlet of the conduit, and onto at least a portion of at least one of the inner panel surface and the at least one buoyant element for rinsing thereof.

17. The hull assembly of claim 16, wherein the at least one hull panel is a plurality of hull panels connected to one another to form the outer surface of the hull.

18. The hull assembly of claim 16, wherein the at least one buoyant element is a plurality of buoyant elements.

19. The hull assembly of claim 16, wherein the at least one outlet is a plurality of outlets distributed along the conduit.

20. The hull assembly of claim 16, wherein the at least one hull panels forms a drain for discharging water from the internal volume of the hull.

* * * * *